US009452867B2

(12) United States Patent
Koestring et al.

(10) Patent No.: US 9,452,867 B2
(45) Date of Patent: Sep. 27, 2016

(54) DRINK CUP LID

(71) Applicant: Berry Plastics Corporation, Evansville, IN (US)

(72) Inventors: Darin C Koestring, Evansville, IN (US); Kyle F Tabor, Palos Hills, IL (US); Ryan Dewig, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 284 days.

(21) Appl. No.: 13/869,668

(22) Filed: Apr. 24, 2013

(65) Prior Publication Data

US 2013/0277380 A1 Oct. 24, 2013

Related U.S. Application Data

(60) Provisional application No. 61/637,617, filed on Apr. 24, 2012, provisional application No. 61/801,433, filed on Mar. 15, 2013.

(51) Int. Cl.
*B65D 43/02* (2006.01)
*B65D 47/08* (2006.01)

(52) U.S. Cl.
CPC ..... *B65D 43/02* (2013.01); *B65D 47/08* (2013.01); *B65D 47/0847* (2013.01)

(58) Field of Classification Search
CPC ..... B65D 43/02; B65D 47/0847; B65D 2251/1008; B65D 2543/00046
USPC ..... 220/254.3, 703, 711, 712, 713; 215/387
See application file for complete search history.

(56) References Cited

U.S. PATENT DOCUMENTS

| | | | | |
|---|---|---|---|---|
| 4,190,174 | A * | 2/1980 | Haimowitz | 220/254.6 |
| 5,151,233 | A | 9/1992 | Wendt | |
| 5,390,810 | A | 2/1995 | Stroble et al. | |
| 5,398,843 | A | 3/1995 | Warden et al. | |
| 5,509,568 | A | 4/1996 | Warden et al. | |
| 5,839,601 | A | 11/1998 | Van Melle | |
| 5,894,952 | A | 4/1999 | Mendenhall et al. | |
| 5,913,964 | A | 6/1999 | Melton | |
| 5,947,323 | A | 9/1999 | Freek et al. | |
| D437,223 | S | 2/2001 | Coy et al. | |
| 6,612,456 | B1 | 9/2003 | Hundley et al. | |
| 6,874,649 | B2 | 4/2005 | Clarke et al. | |
| 6,886,707 | B2 | 5/2005 | Giraud | |
| 6,889,860 | B2 | 5/2005 | Mazzarolo | |
| 6,929,143 | B2 * | 8/2005 | Mazzarolo | 220/254.3 |
| 7,055,715 | B2 | 6/2006 | Maravich et al. | |
| 7,063,224 | B2 | 6/2006 | Clarke et al. | |
| D533,777 | S | 12/2006 | Hundley et al. | |
| 7,156,251 | B2 | 1/2007 | Smith et al. | |
| 7,175,042 | B2 | 2/2007 | Durdon | |

(Continued)

OTHER PUBLICATIONS

PCT International Search Report and Written Opinion completed by the ISA/US on Jun. 19, 2014 and issued in connection with PCT/US2014/027067.

(Continued)

*Primary Examiner* — Fenn Mathew
*Assistant Examiner* — Madison L Poos
(74) *Attorney, Agent, or Firm* — Barnes & Thornburg LLP

(57) ABSTRACT

A lid is configured to mate with a brim of a cup to provide a container. The lid includes an outlet through which a consumer can sip a beverage stored in the cup while the lid is mounted on the brim of the cup.

23 Claims, 11 Drawing Sheets

(56) References Cited

U.S. PATENT DOCUMENTS

| | | | | |
|---|---|---|---|---|
| D556,574 | S | 12/2007 | Hollis et al. | |
| 7,318,536 | B2 | 1/2008 | Maravich et al. | |
| 7,318,563 | B2 | 1/2008 | Houts | |
| 7,353,582 | B2 | 4/2008 | MacKenzie et al. | |
| D570,685 | S | 6/2008 | Koennecke | |
| D570,686 | S | 6/2008 | Hollis et al. | |
| 7,484,639 | B2 | 2/2009 | Maravich et al. | |
| 7,513,382 | B2 | 4/2009 | Clarke et al. | |
| D592,952 | S | 5/2009 | Hundley et al. | |
| 7,549,559 | B2 | 6/2009 | Conroy et al. | |
| 7,676,909 | B2 | 3/2010 | MacKenzie et al. | |
| 7,691,302 | B2 * | 4/2010 | Hollis et al. | 264/154 |
| 7,784,641 | B2 | 8/2010 | Chou | |
| D624,413 | S | 9/2010 | Selina et al. | |
| 7,819,271 | B2 | 10/2010 | Hollis et al. | |
| 7,992,741 | B2 | 8/2011 | Hundley et al. | |
| 8,074,331 | B2 | 12/2011 | Voges | |
| 8,074,831 | B2 | 12/2011 | Walker et al. | |
| 8,317,050 | B2 | 11/2012 | Hollis et al. | |
| 8,430,268 | B2 | 4/2013 | Weiss et al. | |
| 8,544,677 | B2 | 10/2013 | Selina et al. | |
| 8,616,405 | B2 | 12/2013 | French et al. | |
| D696,940 | S | 1/2014 | Hale et al. | |
| 2002/0027139 | A1 | 3/2002 | O'Neill | |
| 2003/0089714 | A1 | 5/2003 | Dart et al. | |
| 2003/0089726 | A1 | 5/2003 | Mazzarolo | |
| 2003/0192890 | A1 | 10/2003 | Mazzarolo | |
| 2004/0178199 | A1 | 9/2004 | Stroup | |
| 2005/0092749 | A1 | 5/2005 | Durdon | |
| 2005/0155969 | A1 | 7/2005 | Clarke et al. | |
| 2006/0071008 | A1 | 4/2006 | Sadlier | |
| 2006/0096983 | A1 | 5/2006 | Patterson | |
| 2006/0180028 | A1 | 8/2006 | Burchard | |
| 2006/0213908 | A1 | 9/2006 | Clarke et al. | |
| 2006/0226148 | A1 | 10/2006 | Hundley et al. | |
| 2006/0255038 | A1 | 11/2006 | Hollis et al. | |
| 2007/0034629 | A1 | 2/2007 | Mazzarolo | |
| 2008/0035681 | A1 | 2/2008 | Skillin | |
| 2008/0105696 | A1 | 5/2008 | Dart et al. | |
| 2008/0245792 | A1 | 10/2008 | Chou | |
| 2009/0266829 | A1 | 10/2009 | Bailey | |
| 2009/0272742 | A1 | 11/2009 | Dybala | |
| 2009/0308882 | A1 | 12/2009 | Hundley | |
| 2010/0037780 | A1 | 2/2010 | Pas et al. | |
| 2011/0011863 | A1 * | 1/2011 | Hollis et al. | 220/254.3 |
| 2012/0024871 | A1 | 2/2012 | Hundley et al. | |
| 2012/0048856 | A1 | 3/2012 | Walker et al. | |
| 2012/0132699 | A1 | 5/2012 | Mann et al. | |
| 2012/0261417 | A1 * | 10/2012 | Tabor et al. | 220/254.1 |
| 2012/0272622 | A1 | 11/2012 | Weiss et al. | |
| 2013/0020338 | A1 | 1/2013 | French et al. | |

OTHER PUBLICATIONS

International Search Report and Written Opinion for International Application No. PCT/US2014/027067, Jul. 15, 2014, 8 pages.

Notice of Non-Final Rejection for U.S. Appl. No. 13/448,050, Oct. 8, 2014, 13 pages.

Notice of Non-Final Rejection for U.S. Appl. No. 13/554,771, Jun. 7, 2013, 14 pages.

Notice of Non-Final Rejection for U.S. Appl. No. 14/214,236, Oct. 3, 2014, 10 pages.

* cited by examiner

DRINK CUP LID

PRIORITY CLAIM

This application claims priority under 35 U.S.C. §119(e) to U.S. Provisional Application Ser. No. 61/637,617, filed Apr. 24, 2012 and to U.S. Provisional Application Ser. No. 61/801,433, filed Mar. 15, 2013, which applications are expressly incorporated by reference herein.

BACKGROUND

The present disclosure relates to lids, and particularly to lids for drink cups. More particularly, the present disclosure relates to a lid that includes a sip hole and a rim that mates with a brim included in a drink cup.

SUMMARY

According to the present disclosure, a lid is adapted to mate with a brim of a cup to provide a container. The lid is formed to include a liquid-discharge outlet communicating with an interior region formed in the cup when the lid is mounted on the brim of the cup. Consumers can sip hot or cold beverages stored in the cup and expelled through the liquid-discharge outlet formed in the lid while the lid is mounted on the brim of the cup.

In illustrative embodiments, the lid includes a dome-shaped central cover formed to include the liquid-discharge outlet and a ring-shaped brim mount arranged to surround the central cover. The brim mount of the lid is configured to mate with the brim of the cup to hold the central cover in a stationary position closing a cup mouth opening into the interior region of the cup and placing the liquid-discharge outlet in fluid communication with any hot or cold liquid stored in the interior region of the cup.

In illustrative embodiments, an inclined top wall of the dome-shaped central closure is formed to include an upwardly opening plug receiver and the liquid-discharge outlet is located between the upwardly opening plug receiver and the ring-shaped brim mount. The inclined top wall is sloped downwardly from a high point formed to include the liquid-discharge outlet toward an opposite low point to cause any liquid that exits the liquid-discharge outlet and is not consumed to flow along the inclined top wall from the high point toward the low point to drain into an upwardly opening annular low-elevation liquid-retention channel formed in the ring-shaped brim mount of the lid.

In illustrative embodiments, the lid further includes an outlet closure including a hinge coupled to the inclined top wall and a closure plate appended to the hinge. The closure plate is movable on the hinge relative to the inclined top wall between a closed position closing the liquid-discharge outlet and an opened position opening the liquid-discharge outlet formed in the inclined top wall.

In illustrative embodiments, the outlet closure further includes a plate-retainer plug coupled to an exterior surface of the closure plate and arranged to extend upwardly away from a floor of the cup when the closure plate is in the closed position. The plate-retainer plug is configured to nest snugly by means of an interference fit in the upwardly opening plug receiver formed in the inclined top wall to retain the closure plate in the opened position at the option of a consumer so that the consumer can sip hot or cold liquid flowing outwardly from the cup through the liquid-discharge outlet easily without allowing flapping or other disruptive motion of the closure plate relative to the top wall as a consumer drinks liquid expelled from the cup.

In illustrative embodiments, the hinge is an extensible member of variable shape that can expand and contract as needed during movement of the closure plate from the closed position to the opened position. This variable shape feature of the hinge facilitates movement of the plate-retainer plug that is coupled to the cover plate into the upwardly opening plug receiver formed in the top wall of the lid upon arrival of the closure plate at the opened position.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 6 is a perspective view of the lid showing that the cover plate of the outlet closure is located in the closed position;

FIG. 7 is an enlarged partial perspective view showing that the outlet closure further includes an upwardly extending plate-retainer plug coupled to the closure plate and a variable-shape hinge interconnecting an inclined top wall included in the dome-shaped central cover and a rear edge of the closure plate and showing movement of the closure plate on the variable-shape hinge away from the closed position shown in FIG. 6 and toward the opened position shown in FIG. 8 and showing the dome-shaped central cover is formed to include an upwardly opening plug receiver arranged to lie in spaced-apart relation to the rim of the lid to locate the liquid-discharge opening therebetween and sized to receive the plate-retainer plug therein once the closure plate has been moved to the opened position shown, for example, in FIG. 8;

FIG. 8 is a view similar to FIG. 7 showing that the closure plate of the outlet closure has been retained in the opened position by means of an interference fit established by mating engagement of the plate-retainer plug and walls cooperating to define the upwardly opening plug receiver;

DETAILED DESCRIPTION

Figure 1:
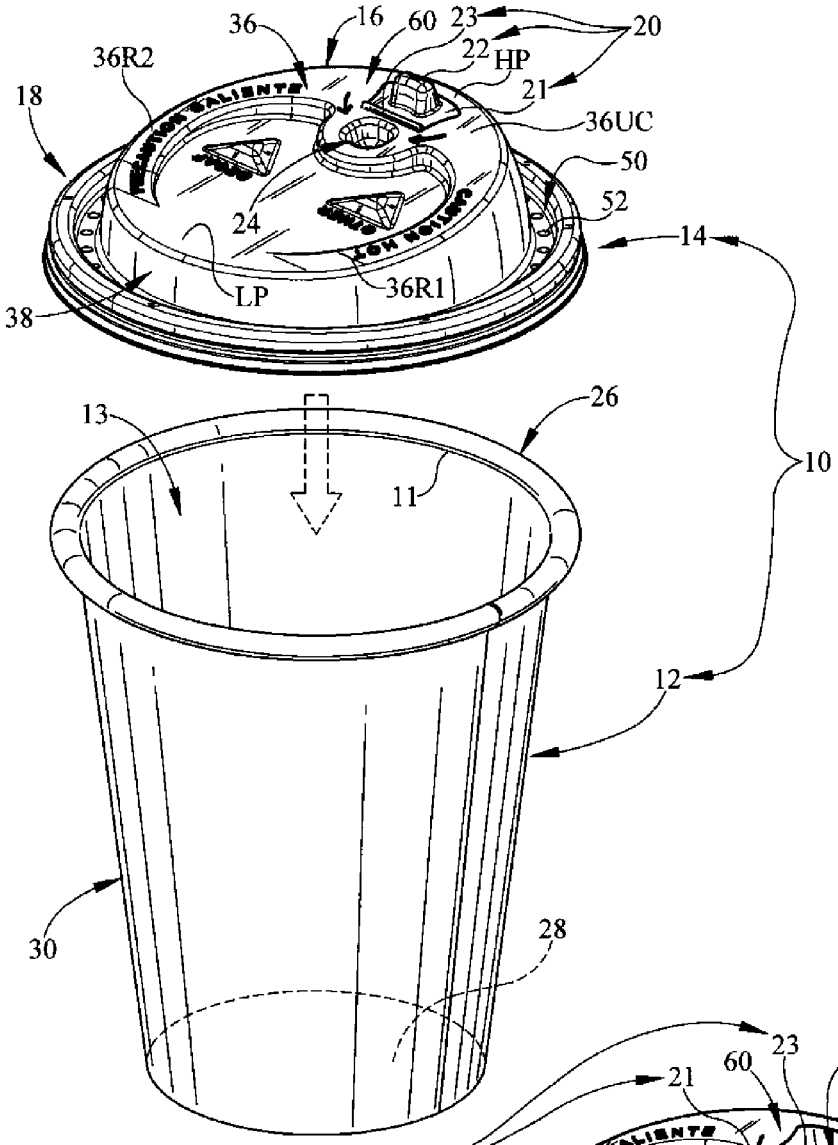
FIG. 1 is a perspective view of a lid in accordance with a first embodiment of the present disclosure and a cup before the lid is mounted on the cup and showing that the lid includes a dome-shaped central cover surrounded by a ring-shaped brim mount.
Figure 2:
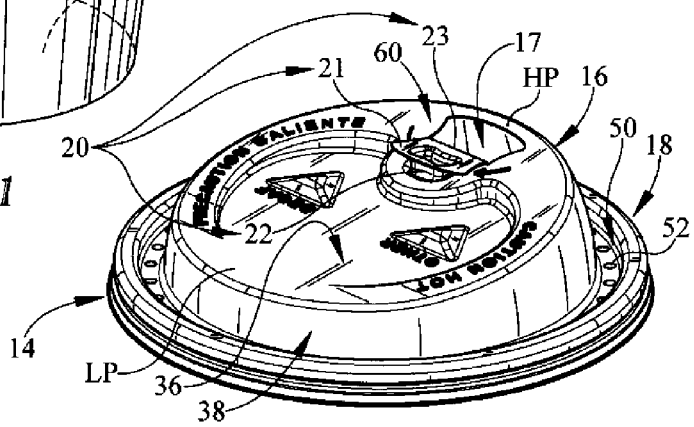
FIG. 2 is a view of the lid shown in FIG. 1 after a consumer has moved a small closure plate included in an outlet closure (shown in more detail in FIGS. 9A and 10A) relative to the dome-shaped central cover from a closed position shown in FIG. 1 to an opened position shown in FIG. 2 to expose a liquid-discharge outlet (i.e., sip hole) formed in the dome-shaped central cover.
Figure 17:
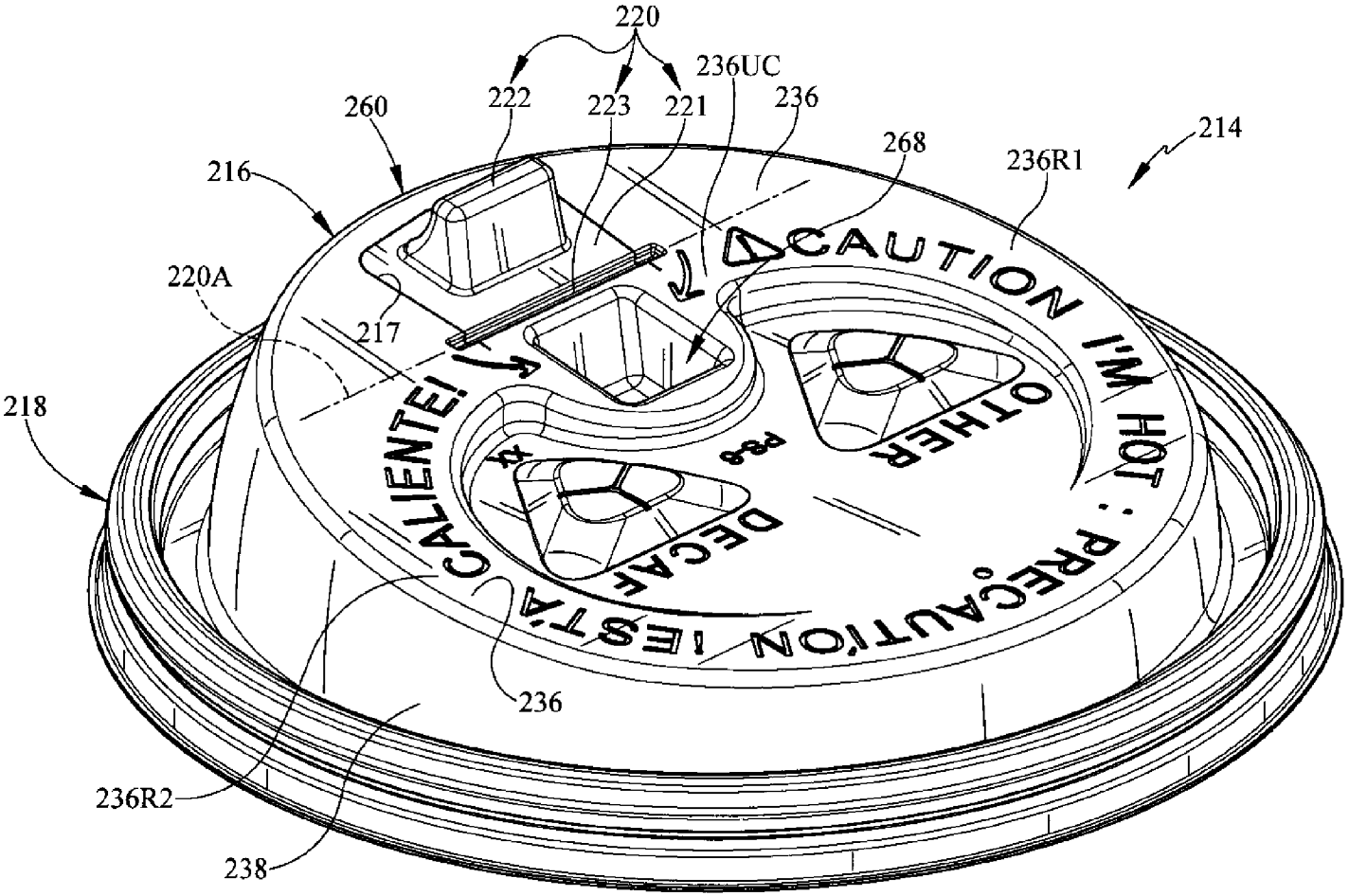
FIG. 17 is a perspective view of the lid of FIGS. 14 and 15 showing that the lid also includes an outlet closure positioned to lie at about a 10 o'clock position on an inclined top wall of the central closure in a closed position closing a liquid-discharge outlet formed in the inclined top wall of the central cover.
Figure 18:
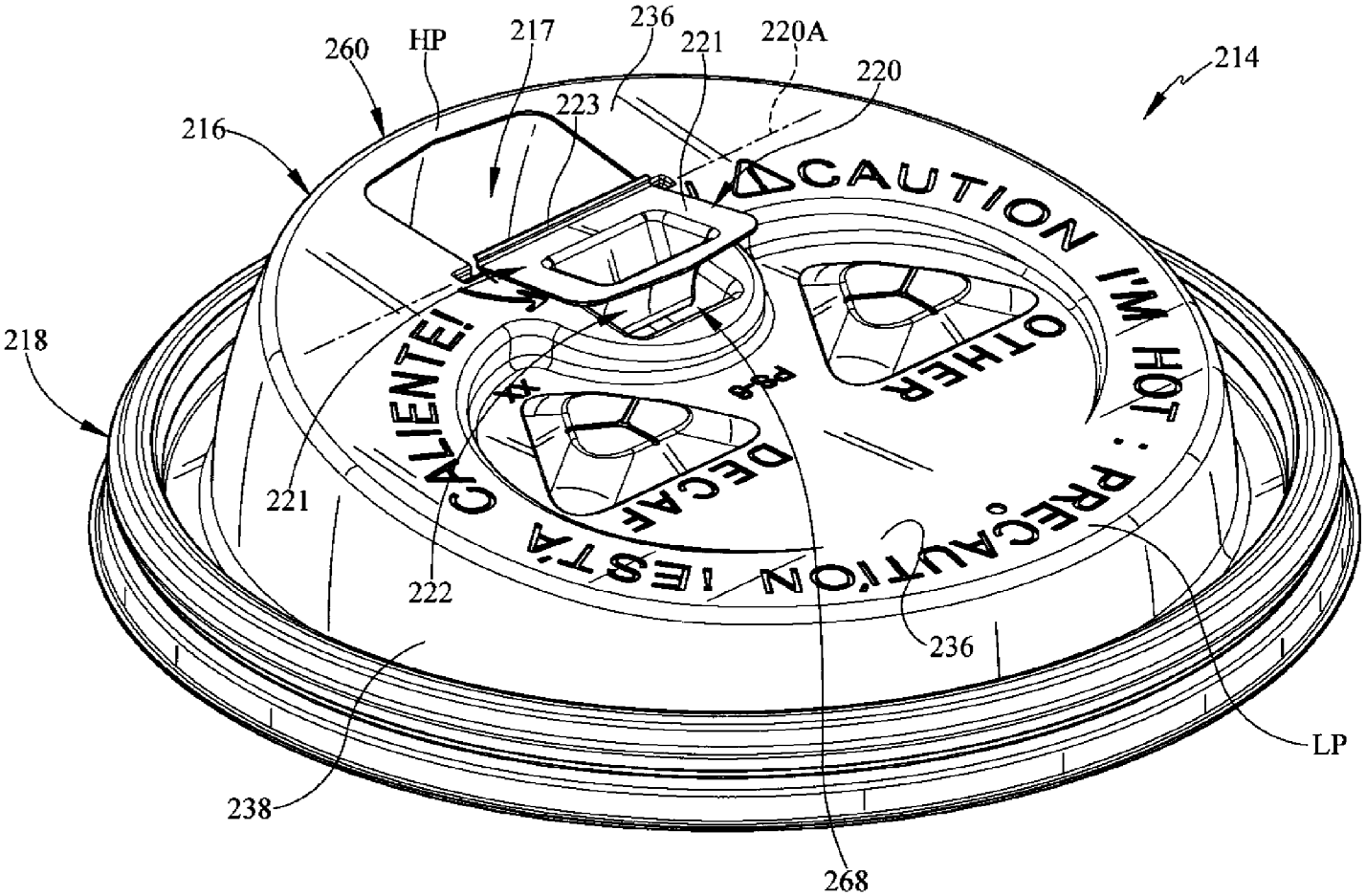
FIG. 18 is a perspective view of the lid similar to FIG. 17 showing the outlet closure after it has been pivoted in a forward direction about a horizontal pivot axis to an outlet-opening position opening the liquid-discharge outlet to cause a plate-retainer plug included in the outlet closure to extend into a plug receiver formed in the inclined top surface of the central closure.

A liquid container 10 includes a cup 12 and a lid 14 in accordance with a first embodiment of the present disclosure as shown in FIGS. 1-13. Lid 14 includes a central cover 16 formed to include a liquid-discharge outlet 17 and an annular brim mount 18 arranged to surround central cover 16 as shown in FIG. 2. Lid 14 also includes an outlet closure 20 that is movable by a consumer to open and close liquid-discharge outlet 17 as shown in FIGS. 1 and 2. A liquid container 210 includes cup 12 and a lid 214 in accordance with a second embodiment of the present disclosure as shown in FIGS. 14-18. Lid 214 includes a pivotable outlet closure 220 that is pivotable by a consumer about a pivot axis 220A to open and close a liquid-discharge outlet 217 as shown in FIGS. 17 and 18.

Figure 6:
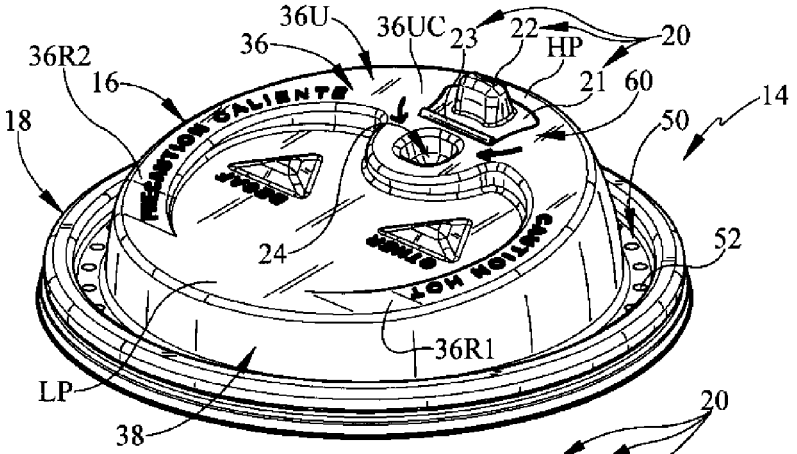
FIGS. 6-8 show movement of the closure plate from a closed position to an opened position to expose the liquid-discharge outlet formed in the dome-shaped central cover so that a consumer can use the liquid-discharge outlet to sip a beverage stored in the container while the lid is mounted on the brim of the cup.

Lid 14 of container 10 includes a closure plate 21, a plate-retainer plug 22 coupled to closure plate 21 to move therewith, and a variable-shape hinge 23 coupled to dome-shaped central cover 16 and to closure plate 21. Hinge 23 is extensible and configured to vary in shape as needed to provide means for supporting closure plate 21 for movement between a closed position closing liquid-discharge outlet 17 as shown in FIGS. 1, 6, and 9A and an opened position exposing liquid-discharge outlet 17 as shown in FIGS. 2 and 8 so that plate-retainer plug 22 can extend into an upwardly opening plug receiver 24 formed in dome-shaped central cover 16 and establish an interference fit therein to retain closure plate 21 in the opened position.

Figure 3:
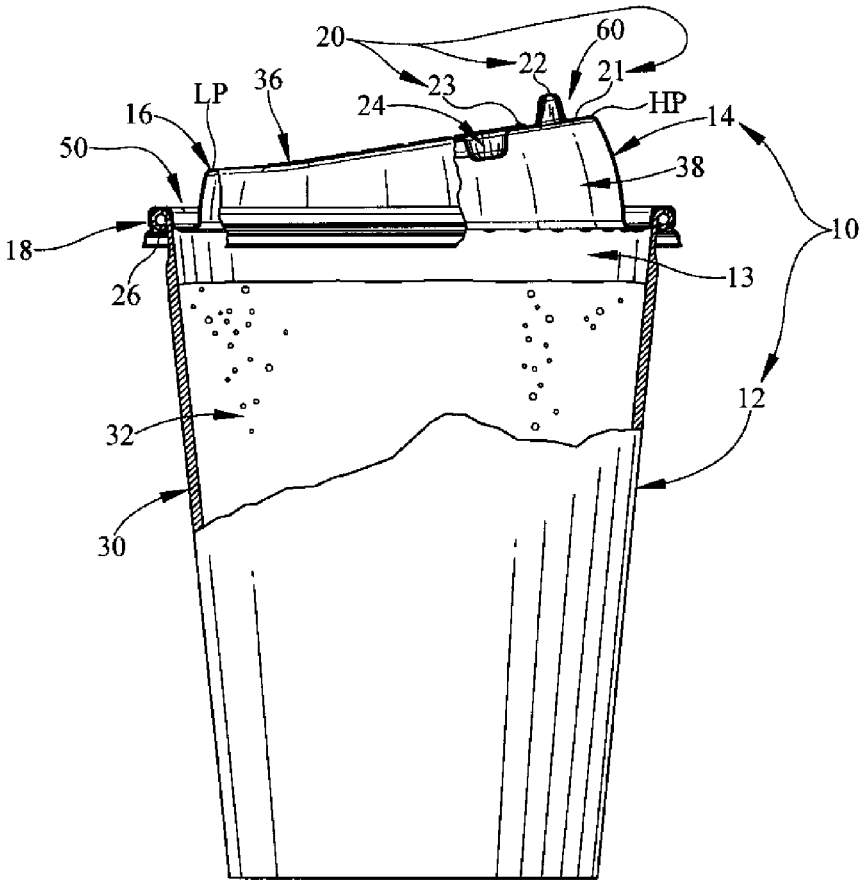
FIG. 3 is a side elevation view of the container of FIG. 1, with portions broken away, after the lid has been mounted on the brim of the cup.

As shown in FIGS. 1 and 3, cup 12 includes a brim 26, a floor 28, and a side wall 30 extending upwardly from floor 28 to brim 26. It is within the scope of this disclosure to make cup 12 out of any suitable plastics, paper, or other material(s).

Figure 8:
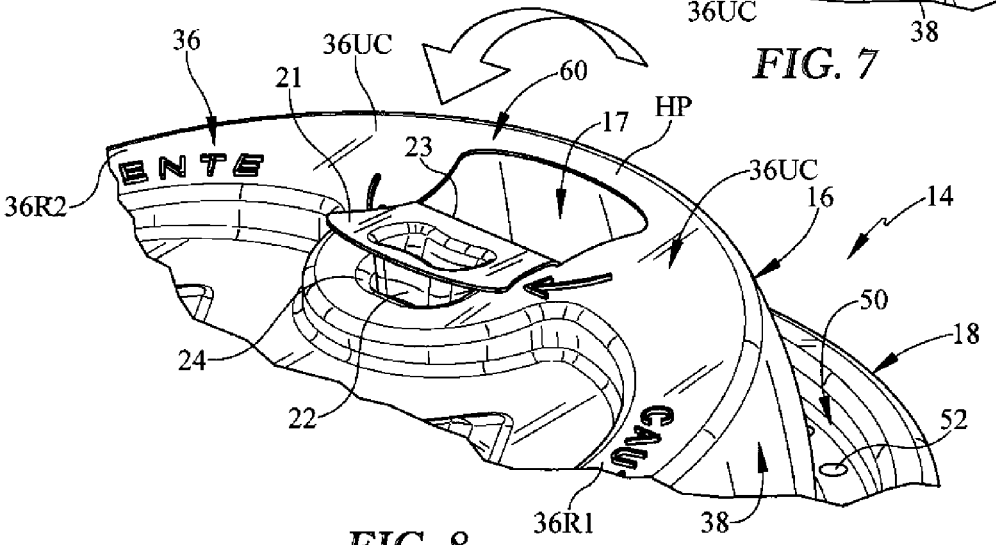
Figure 9A:
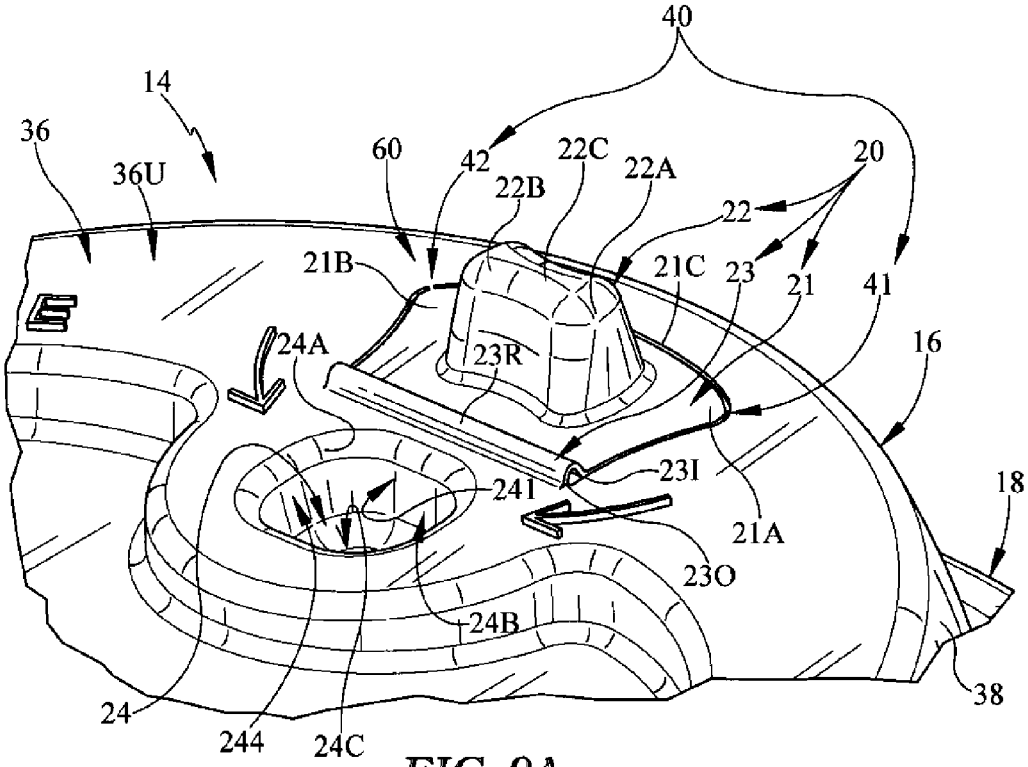
FIG. 9A is an enlarged partial top perspective view of a topside of the lid showing illustrative shapes of the variable-shape hinge, closure plate, and plate-retainer plug of the outlet closure and an illustrative shape of the plug receiver coupled to the dome-shaped central cover.
Figure 10A:
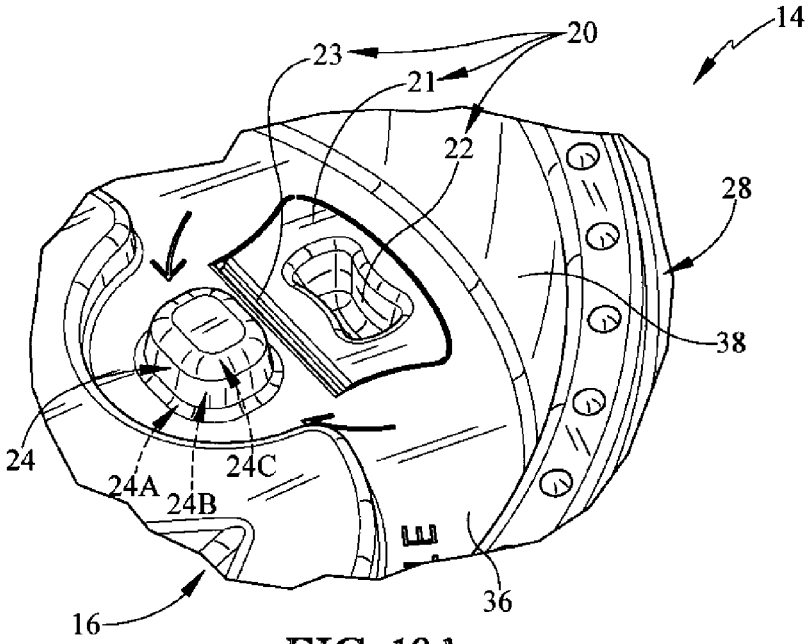
FIG. 10A is an enlarged partial bottom perspective view of an underside of the lid showing illustrative shapes of the variable-shape hinge, closure plate, and plate-retainer plug of the outlet closure and an illustrative shape of the plug receiver coupled to the dome-shaped central cover.

In an illustrative embodiment, a consumer can sip liquid 32 stored in interior region 13 of cup 12 while lid 14 remains mounted on brim 26 of cup 12 through the liquid-discharge outlet 17 formed in dome-shaped central cover 16 of lid 14 after closure plate 21 has been moved on hinge 23 to an opened position shown in FIGS. 2 and 8. In an illustrative embodiment, central cover 16 of lid 14 includes a drink spout 60 formed to include liquid-discharge outlet 17 as suggested in FIGS. 1 and 2. Brim 26 of cup 12 defines a mouth 11 opening into interior region 13 of cup 12 as suggested in FIG. 1.

Dome-shaped central cover 16 rises upwardly above the surrounding brim mount 18 as shown, for example, in FIG. 2. The portion of central cover 16 that is formed as the drink spout 60 to include liquid-discharge outlet 17 is sized and shaped in illustrative embodiments so that it is adapted to be received in the mouth of a consumer desiring to drink liquid 32 stored in cup 12.

Figure 4:
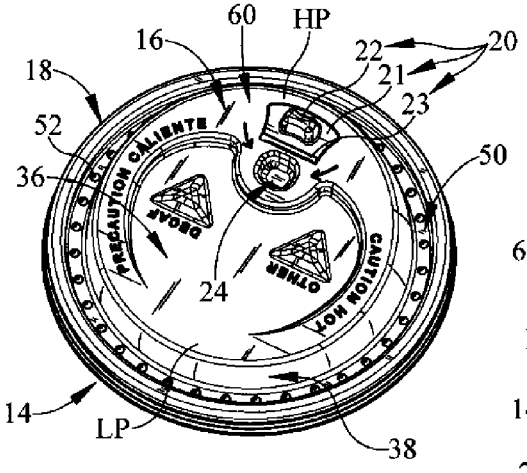
FIG. 4 is a top perspective view of the lid of FIGS. 1 and 2 taken from a FRONT vantage point.
Figure 5:
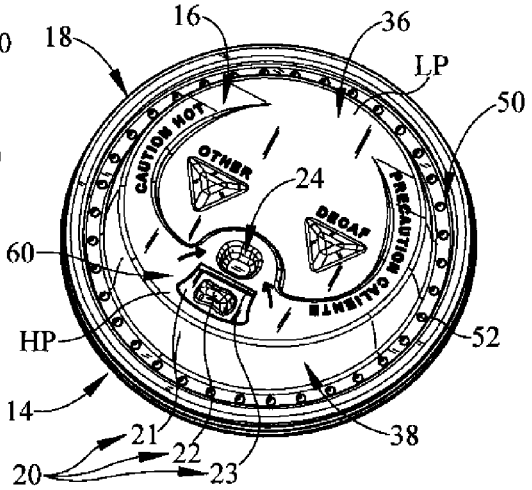
FIG. 5 is a top perspective view of the lid of FIG. 4 taken from a REAR vantage point.

Dome-shaped central cover 16 includes a top wall 36 and an endless side wall 38 as shown, for example, in FIGS. 3-5. A top edge of endless side wall 38 is coupled to a perimeter edge of top wall 36. Endless side wall 38 extends downwardly from top wall 36 to mate with the surrounding annular brim mount 18.

Figure 7:
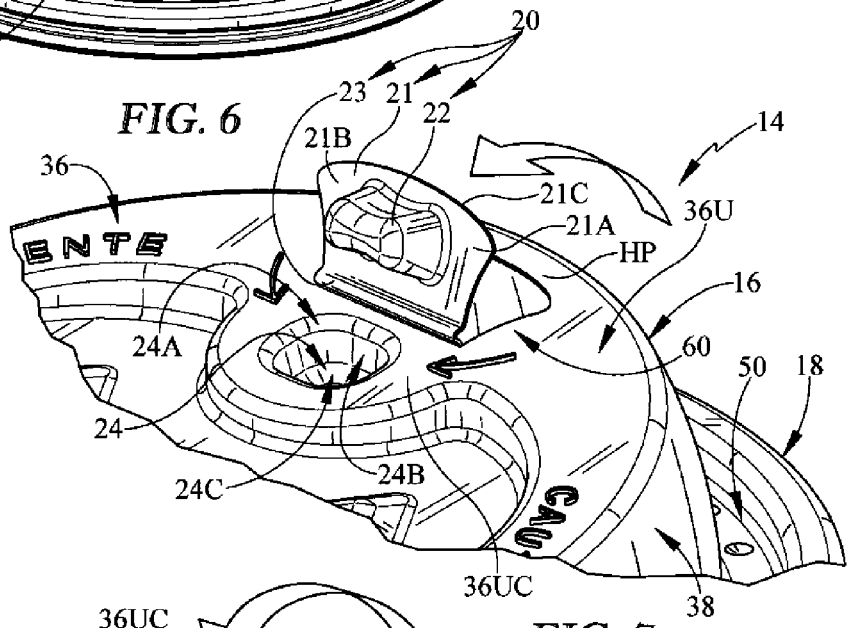

Outlet closure 20 is operated manually by a consumer to open liquid-discharge outlet 17 in a manner shown, for example, in FIGS. 6-8 so that the consumer can sip liquid 32 stored in cup 12 through liquid-discharge outlet 17 while lid 14 remains mounted on brim 26 of cup 12. A consumer may elect to grip the upstanding nose-shaped plug 22 and move plug 22 relative to top wall 36 to cause closure plate 21 to move from the closed position to an opened position as suggested in FIGS. 7 and 8.

Once a closure plate 21 included in outlet closure 20 is moved by the consumer from the closed position shown in FIG. 6 to the opened position shown in FIG. 8, a plate-retainer plug 22 coupled to closure plate 21 to move therewith is moved relative to top wall 36 of dome-shaped central cover 16 of lid 14 to (1) extend into a companion upwardly opening plug receiver 24 formed in top wall 36 and to (2) remain in such a nested position owing to establishment of an interference fit between plate-retainer plug 22 and one or more of side walls 241-244 defining the upwardly opening plug receiver 24. A variable shape feature of the extensible hinge 23 that is arranged to interconnect closure plate 21 and top wall 36 facilitates movement of plate-retainer plug 22 into the upwardly opening plug receiver 24 during movement of closure plate 21 from the closed position shown, for example, in FIG. 6 to the opened position shown, for example in FIG. 8.

Outlet closure 20 is shown, for example, in FIG. 9A and includes cover plate 21, plate-retainer plug 22, variable-shape hinge 23, and a frangible plate anchor 40 comprising first and second frangible connectors 41, 42. Each of frangible connectors 41, 42 is arranged to couple a free end of closure plate 21 to an adjacent portion of top wall 36 of dome-shaped central cover 16 as suggested in FIGS. 9A and 9B to retain closure plate 21 in the closed position closing liquid-discharge outlet 17 when lid 14 is made at a factory until a consumer moves closure plate 21 toward the opened position for the first time causing frangible connectors 41, 42 to break as suggested in FIGS. 6 and 7.

Figure 9B:
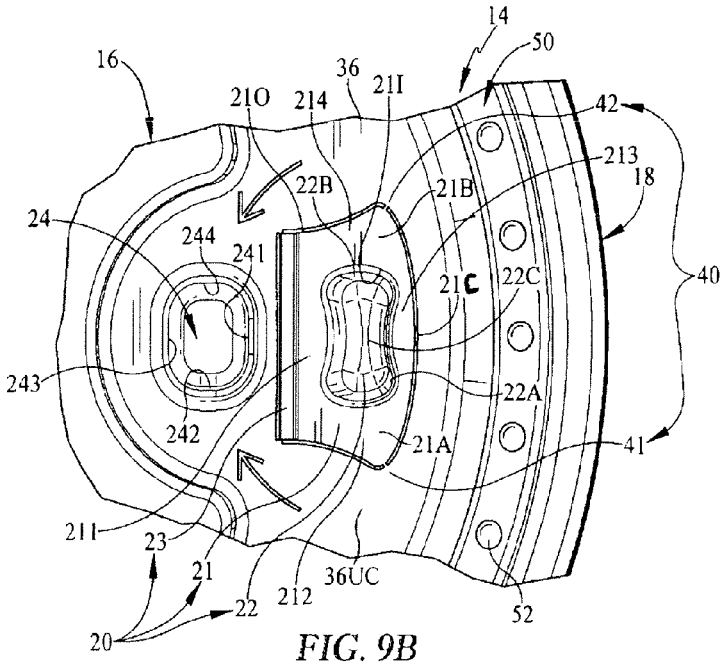
FIG. 9B is a top plan view of the lid portion shown in FIG. 9A.
Figure 10B:
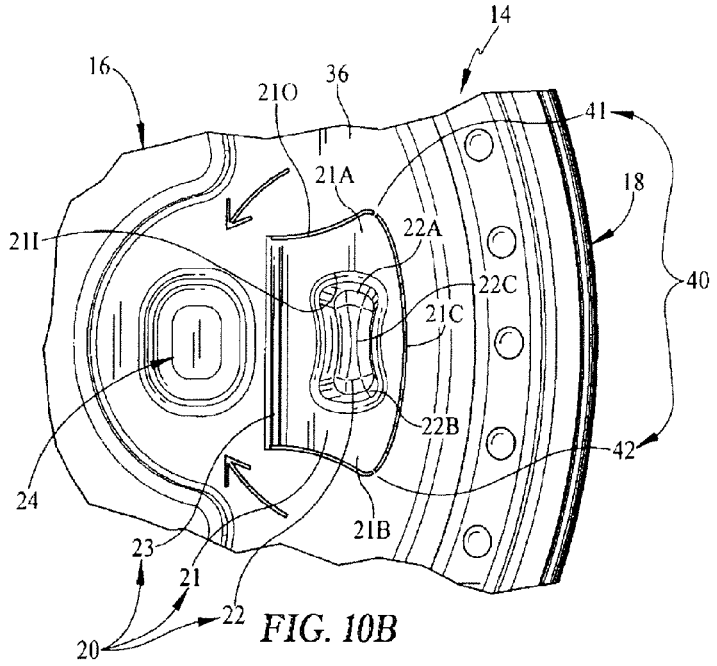
FIG. 10B is a bottom view of the lid portion shown in FIG. 10A.
Figure 11:
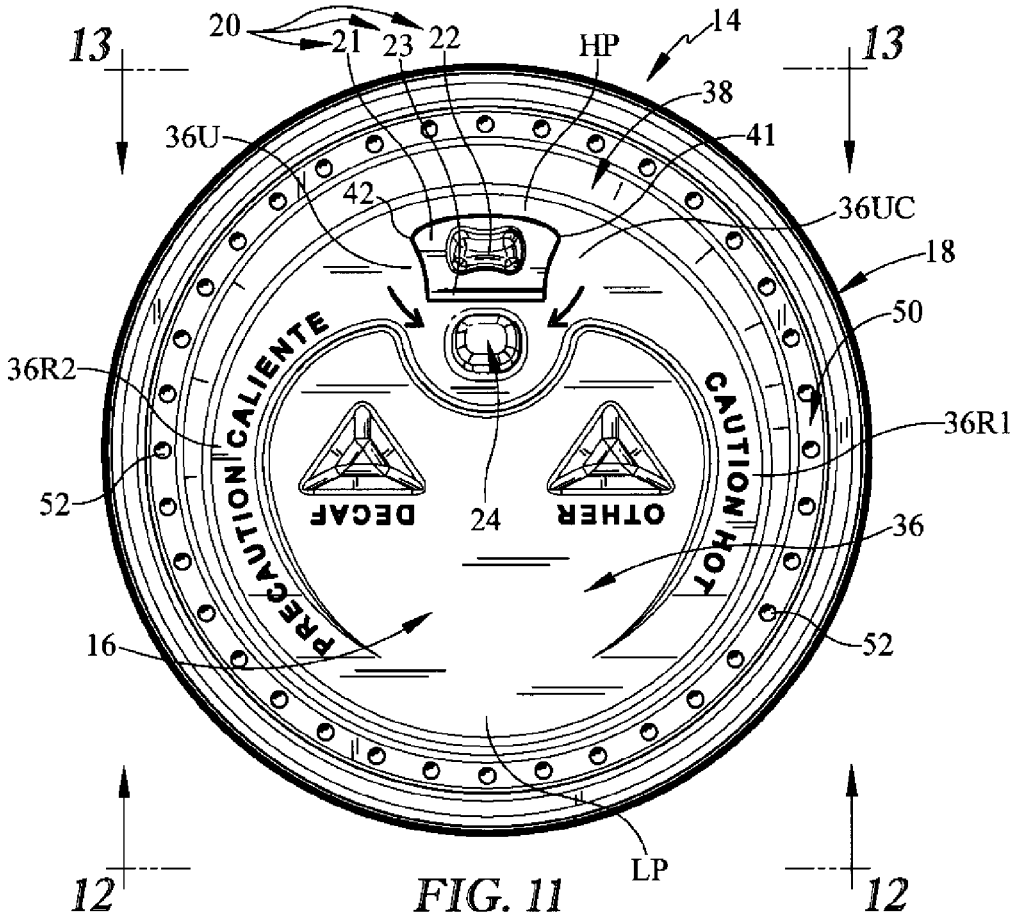
FIG. 11 is a top plan view of the lid of FIGS. 1 and 2.
Figure 12:
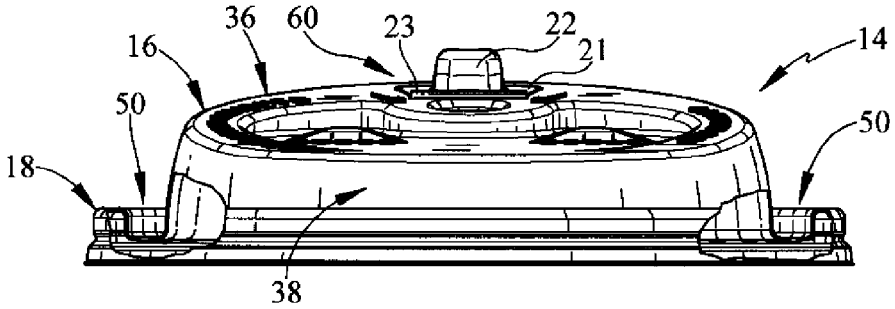
FIG. 12 is a front elevation view of the lid of FIG. 11.
Figure 13:
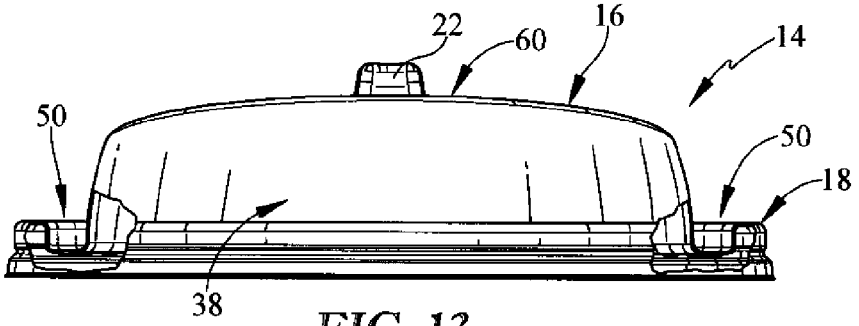
FIG. 13 is a rear elevation view of the lid of FIG. 11.

Closure plate 21 is shaped to resemble a slice of bread in a first illustrative embodiment as suggested in FIGS. 9B and 11. Closure plate 21 includes a narrow base coupled to hinge 23 and a relatively wider head including a convex outer edge 21C as shown, for example, in FIG. 9B. Closure plate 21 includes a first peninsula 21A located at one end of convex outer edge 21C and coupled to first frangible connector 41 and an oppositely extending second peninsula 21B located at an opposite end of convex outer edge 21C and coupled to second frangible connector 42.

Plate-retainer plug 22 is rooted on a central region of closure plate 21 and arranged to rise upwardly therefrom as shown, for example, in FIG. 9A. Plate-retainer plug 22 is dog bone-shaped in plan and has a bulbous first end 22A, a bulbous second end 22B, and a relatively narrow connector 22C interconnecting first and second bulbous ends 22A, 22B as shown, for example, in FIG. 9B.

Plug receiver 24 is formed in top wall 36 of dome-shaped central cover 16 to receive plate-retainer plug 22 therein upon movement of closure plate 21 to an opened position as shown, for example, in FIGS. 2 and 8. As suggested in FIG. 9A, plug receiver 24 includes a border ring 24A coupled to top wall 36, a lower bowl 24C arranged to lie below border ring 24A, and an intermediate ring 24B arranged to interconnect border ring 24A and lower bowl 24C as shown, for example, in FIGS. 9A and 10. Border ring 24A is characterized by a first slope and intermediate ring 24B is characterized by a relative steeper second slope. Border ring 24A provides a lead-in ramp configured to provide means for guiding plate-retainer plug 22 into a space bounded by intermediate ring 24B and into a lower elevation space bounded by lower bowl 24C during movement of closure plate 21 to the closed position as suggested in FIGS. 7 and 8.

Variable-shape hinge 23 is extensible and configured to stretch and retract as needed during movement of plate-retainer plug 22 into plug receiver 24 upon movement of closure plate 21 to the opened position. Variable-shape hinge 23 has an elongated half-round shape in an illustrative embodiment as shown, for example, in FIG. 9A. Hinge 23 includes an inner edge 231 coupled to closure plate 21, an outer edge 230 coupled to top wall 36 of dome-shaped central cover 16, and a curved ridge 23R arranged to interconnect inner an outer edges 231, 230 as suggested in FIG. 9A. Curved ridge 23R includes a convex exterior surface arranged to face away from floor 28 of cup 12 when lid 14 is mounted on cup 12 as suggested in FIGS. 1 and 9A and an oppositely facing concave interior surface as suggested in FIGS. 9A and 10A. Hinge 23 is an extensible member and can expand and contract as needed during movement of closure plate 21 from the closed position shown in FIG. 6 to the opened position shown in FIG. 8. This variable shape feature of hinge 23 facilitates movement of plate-retainer plug 22 coupled to closure plate 21 into a companion plug receiver 24 formed in top wall 36 of lid 14 upon arrival of closure plate 21 at the opened position. Hinge 23 is a living hinge and has an irregular shape in an illustrative embodiment which gives ability for larger tolerance where plate-retainer plug 22 is received in plug receiver 24.

Top wall 36 of central cover 16 is inclined to slope downwardly as suggested in FIGS. 3-5 from a high point HP formed to include liquid-discharge outlet 17 toward an opposite low point LP lying along a diameter of lid 14 that also intersects the high point HP as suggested in FIGS. 2 and 3. Such sloping orientation of inclined top wall 36 causes any liquid 32 that exits container 10 through liquid-discharge outlet 17 (and not consumed by a consumer sipping liquid from an opened liquid-discharge outlet 17) to flow downwardly along the inclined top wall 36 to drain into an upwardly opening annular low-elevation liquid retention channel 50 formed in annular brim mount 18 of lid 14 and arranged to surround endless side wall 38 of dome-shaped central cover 16.

In illustrative embodiments, an annular floor of liquid-retention channel 50 may be formed to include a series of liquid-retention cells 52. Any overflow liquid discharged into liquid-retention channel 50 will begin to fill these liquid-retention cells 52 that are designed and configured to trap liquid therein to minimize sloshing and splashing of liquid flowing into liquid-retention channel 50 from a higher elevation on inclined top wall 36 of dome-shaped central cover 16.

As suggested in FIG. 6, inclined top wall 36 of dome-shaped central cover 16 of lid 14 includes a crescent-shaped upper level 36U comprising high point HP, liquid-discharge outlet 17, and plug receiver 24 and a central lower level 36L comprising low point LP and surrounded mostly (except for low point LP) by upper level 36U. Upper level 36U includes a center platform 36UC formed to include high point HP, liquid-discharge outlet 17, and plug receiver 24 and to position liquid-discharge outlet 17 between plug receiver 24 and a portion of annular brim mount 18. Upper level 36U also includes sloped first and second curved ridges 36R1, 36R2 sweeping downwardly from center platform 36UC in opposite directions along a perimeter edge of top wall 36 to end in close proximity to one another to locate low point LP therebetween as suggested in FIG. 6.

A lid 14 includes a central cover 16 and a brim mount 18 as shown, for example, in FIGS. 1 and 2. Central cover 16 is formed to include a liquid-discharge outlet 17 and an upwardly opening plug receiver 24. Brim mount 18 is arranged to surround central cover 16 and adapted to mate with the brim 26 of a cup 12. Brim mount 18 cooperates with central cover 16 to close a mouth 11 opening into an interior region 13 formed in cup 12 and place liquid-discharge outlet 17 in fluid communication with interior region 13 of cup 12.

Lid 14 also includes an outlet closure 20 including a hinge 23 coupled to central cover 16 and a closure plate 21 appended to hinge 23 for movement relative to central cover 16 between a closed position closing liquid-discharge outlet 17 as shown in FIG. 2 and an opened position opening liquid-discharge outlet 17 as shown in FIG. 1. Outlet closure 20 further includes a plate-retainer plug 22 coupled to closure plate 21 and arranged to extend upwardly away from a floor 28 of cup 12 when lid 14 is mounted on brim 26 of cup 12 and closure plate 21 is in the closed position as suggested in FIG. 1. Plate-retainer plug 22 is configured to provide retainer means for nesting snugly to establish an interference fit in an upwardly opening plug receiver 24 formed in central cover 36 to retain closure plate 21 in the opened position at the option of a consumer as suggested in FIG. 2 so that the consumer can sip a liquid flowing outwardly from interior region 13 of cup 12 through liquid-discharge outlet 17 without allowing flapping motion of closure plate 21 relative to central cover 16 as the consumer drinks a liquid expelled from cup 12.

Central cover 16 includes an inclined top wall 36 formed to include liquid-discharge outlet 17 and the upwardly opening plug receiver 24 and an endless side wall 38 arranged to surround the inclined top wall 36 as suggested in FIGS. 1 and 2. A top edge of endless side wall 38 is coupled to a perimeter edge of the inclined top wall 36. Endless side wall 38 extends downwardly from inclined top wall 36 to mate with brim mount 26 surrounding central cover 16. Inclined top wall 36 is inclined to lie in a non-horizontal plane when brim mount 18 of lid 14 is mated with brim 26 of cup 12. Endless side wall 38 is arranged to surround the upwardly opening plug receiver 24 and, when the plate-retainer plug 22 is arranged to extend into the upwardly opening plug receiver 24 to retain the closure plate 21 in the opened position, to surround at least a tip of plate-receiver plug 22 located in upwardly opening plug receiver 24 as suggested in FIG. 2.

Inclined top wall 36 is sloped downwardly from a high point HP formed to include liquid-discharge outlet 17 toward an opposite low point LP to locate liquid-discharge outlet 17 at an elevation that is relatively higher than that of the upwardly opening plug receiver 24 as suggested in FIG. 2. Endless side wall 38 includes a bottom edge that is coupled to brim mount 18 and the bottom and top edges are arranged to lie in spaced-apart relation to one another to define a height of endless side wall 38. The height of the endless side wall 38 varies from a smallest dimension at the low point LP to a relatively greater largest dimension at the high point HP. Liquid-discharge outlet 17 and the upwardly opening plug receiver 24 are arranged to lie in spaced-apart relation to one another to locate hinge 23 of the outlet closure 20 therebetween as suggested in FIG. 2.

Endless side wall 38 has a convex exterior surface as suggested in FIGS. 1, 2, 12, and 13. A portion of the convex exterior surface of endless side wall 38 and a neighboring portion of an exterior surface of the top wall 36 at the high point HP cooperate to form drink spout means 60 for mating with lower and upper lips of a consumer when closure plate 21 is retained in the opened position by nesting engagement of plate-retainer plug 22 in the upwardly facing plug receiver 24.

Closure plate 21 has an annular shape and is formed to include an inner edge 211 and an outer edge 21O surrounding the inner edge 21I as suggested in FIG. 9B. Plate-retainer plug 22 is coupled to closure plate 21 along the inner edge 21I to lie in a fixed position on closure plate 21 for movement therewith relative to central cover 16. Hinge 23 is coupled to closure plate 21 at the outer edge 21O.

Closure plate 21 has a non-round shape and (as shown in FIG. 9B) comprises, in series, a first elongated segment 211 located between plate-retainer plug 22 and hinge 23, a second elongated segment 212 arranged to extend at about a right angle to hinge 23, a third elongated segment 213 arranged to lie in spaced-apart relation to the first elongated segment 211 to locate plate-retainer plug 22 therebetween, and a fourth elongated segment 214 arranged to interconnect the first and third elongated segments 211, 213 and to lie in spaced-apart relation to the second elongated segment 212 to locate plate-retainer plug 22 therebetween as suggested in FIG. 9B. Closure plate 21 has a substantially planar top surface that is arranged to lie in substantially coplanar relation to the inclined top wall 36 upon movement of closure plate 21 to assume the closed position as suggested in FIGS. 1 and 6. Annular closure plate 21 is a flange coupled to a lower edge of plate-retainer plug 22 and arranged to cooperate with a portion of inclined top wall 36 of central cover 16 to define an acute angle therebetween when plate-retainer plug 22 is moved to extend into the upwardly opening plug receiver 24 formed in inclined top wall 36 of central cover 16.

A liquid container 210 includes a cup 12 and a lid 214 in accordance with a second embodiment of the present disclosure as shown in FIGS. 14-18. Lid 214 is adapted to mate with brim 26 of cup 12 as suggested in FIG. 14.

Figure 14:
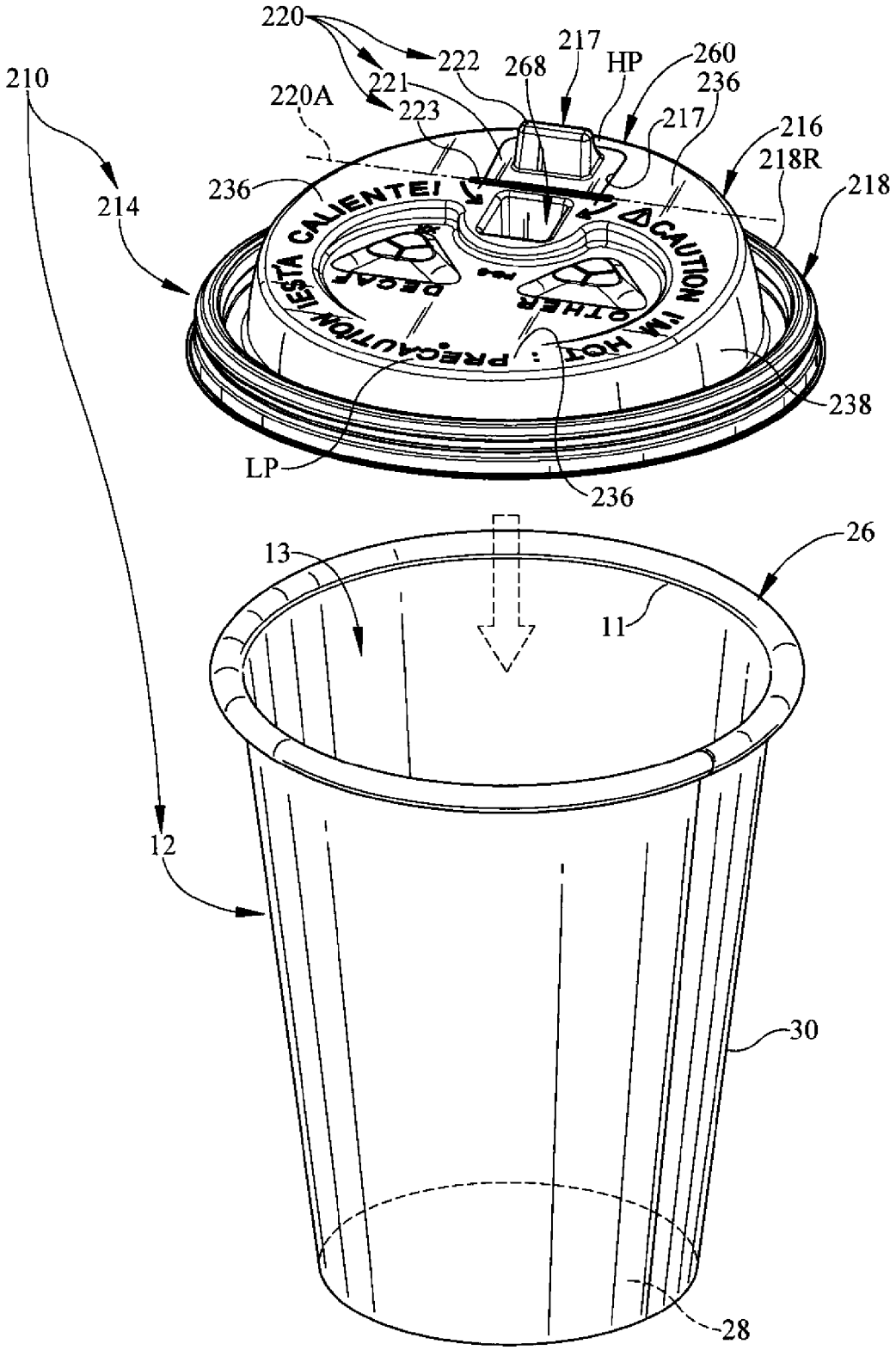
FIG. 14 is a perspective view of a lid in accordance with a second embodiment of the present disclosure and a cup before the lid is mounted on the cup and showing that the lid includes a ring-shaped brim mount adapted to mate with the brim of the cup and a dome-shaped central cover surrounded by the brim mount.

Lid 214 includes a central cover 216 formed to include a liquid-discharge outlet 217, a pivotable outlet closure 220, and brim mount 218 coupled to central cover 216 and configured to be mounted on a brim 26 of cup 12 to hold central cover 216 in a stationary position closing a cup mouth 11 opening into an interior region 13 formed in cup 12 and placing liquid-discharge outlet 217 in fluid communication with any liquid stored in interior region 13 of cup 12 as suggested in FIG. 14. Brim mount 218 is ring-shaped in an illustrative embodiment and arranged to surround central cover 216 as shown, for example, in FIGS. 14 and 15. Lid 214 (like lid 14) is made of, for example, polystyrene, polypropylene, or polyethylene using a thermoforming process (or other suitable process) in illustrative embodiments.

Figure 15:
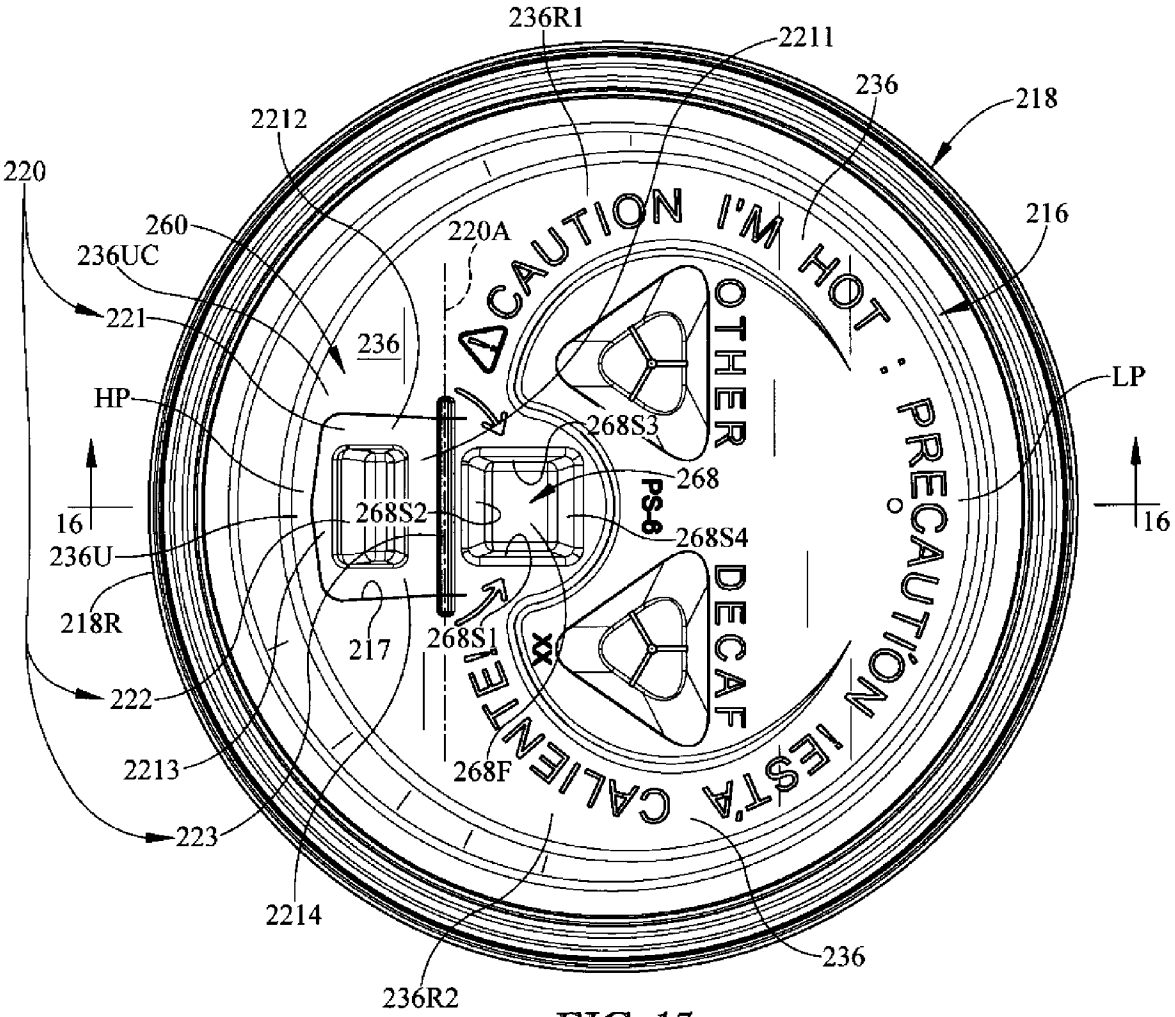
FIG. 15 is an enlarged top plan view of the lid of FIG. 14.
Figure 16:
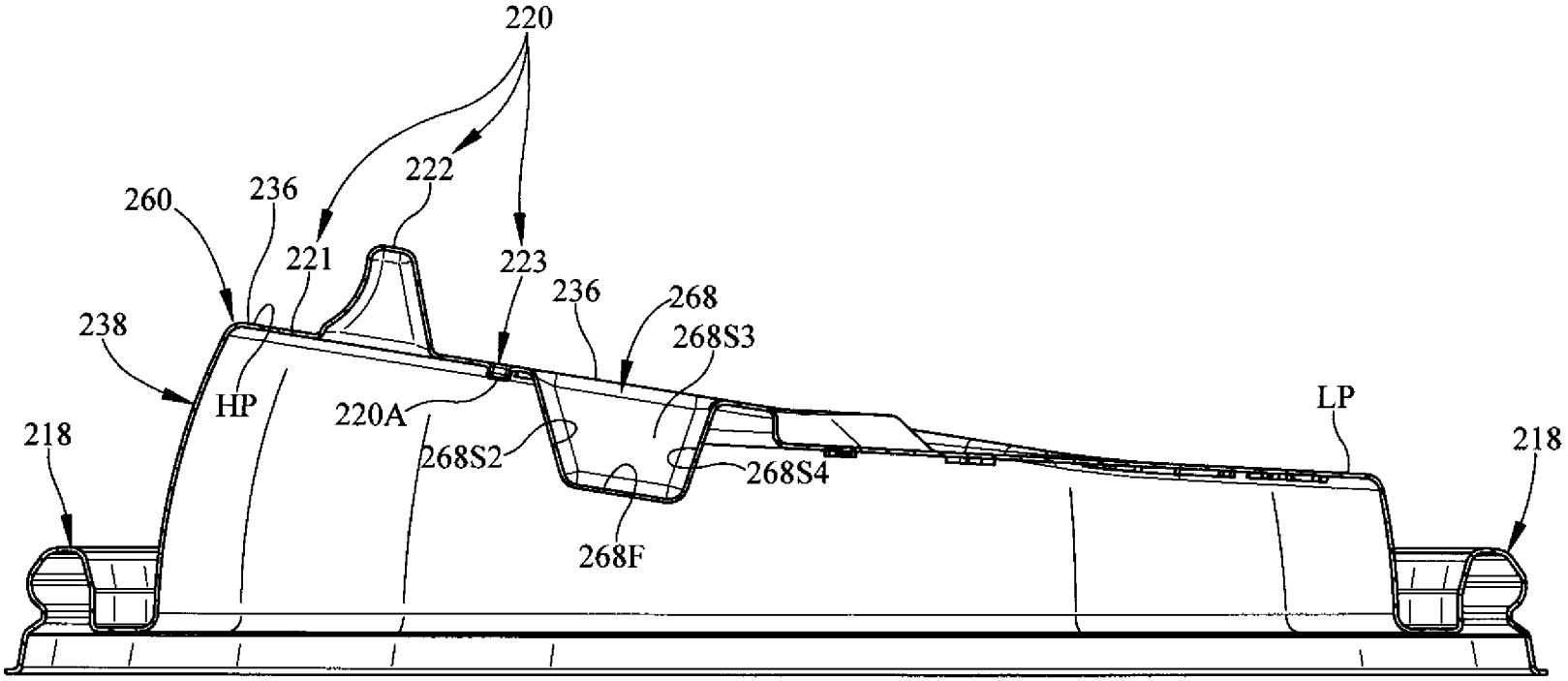
FIG. 16 is an enlarged sectional view taken along line 16-16 of FIG. 15 showing the cross-sectional shape of the brim mount of the lid.

Central cover 216 includes a drink spout 260 including an inclined top wall 236 formed to include a liquid-discharge outlet 217 and to include a closure retainer 268 as suggested in FIGS. 14-16. Inclined top wall 236 slopes downwardly toward brim mount 218 from a high point HP at liquid-discharge outlet 217 to an opposite low point LP as suggested in FIGS. 14 and 15. Outlet closure 220 is mounted on central cover 16 for pivotable movement about pivot axis 220A between a closed position closing liquid-discharge outlet 217 as shown in FIGS. 14-17 and an opened position opening liquid-discharge outlet 217 and mating with the closure retainer 268 provided on inclined top wall 236 of drink spout 260 to retain outlet closure 220 in an opened position as shown in FIG. 18.

As shown in FIGS. 14 and 15, cup 12 includes a brim 26, a floor 28, and a side wall 30 extending upwardly from floor 28 to brim 26. Side wall 30 and floor 28 cooperate to form interior region 13 of cup 12. It is within the scope of this disclosure to make cup 12 out of any suitable plastics, paper, or other material(s).

In an illustrative embodiment, a consumer can drink liquid stored in cup 12 while lid 214 remains mounted on the brim 26 of cup 12 through the opened liquid-discharge outlet 217 formed in lid 214 after the consumer has pivoted outlet closure 220 to an opened position shown, for example, in FIG. 18. In an illustrative embodiment, central cover 216 of lid 214 includes a drink spout 260 formed to include liquid-discharge outlet 217 as suggested in FIGS. 14, 17, and 18. Drink spout 260 is adapted to be received in the mouth of a consumer desiring to drink a liquid stored in cup 12 once outlet closure 220 has been moved to an opened position.

Central cover 216 rises upwardly above brim mount 218 as suggested in FIGS. 14 and 16. Drink spout 260 is formed to include a high-elevation liquid-discharge outlet 217 and is located inside a rear semicircular portion 218R of brim mount 218 as suggested in FIGS. 14 and 15. Any liquid stored in interior region 13 of cup 12 is in fluid communication with the liquid-discharge outlet 217 formed in the inclined top wall 236 of the upstanding drink spout 260 as suggested in FIG. 14.

Dome-shaped central cover 216 includes an inclined top wall 236 and an endless side wall 238 as shown, for example, in FIGS. 14-18. A top edge of endless side wall 238 is coupled to a perimeter edge of the inclined top wall 236. Endless side wall 238 extends downwardly from top wall 236 to mate with the surrounding annular brim mount 218.

Outlet closure 220 includes an annular closure plate 221, an upstanding nose-shaped plate-retainer plug 222 coupled to an inner edge of annular closure plate 221, and a hinge 223 coupled to a forwardly facing segment of an outer edge of annular closure plate 221 and to drink spout 260 along horizontally extending pivot axis 220A as shown, for example, in FIGS. 14 and 15. Annular closure plate 221 is a flange coupled to a lower edge of upstanding nose-shaped plate-retainer plug 222 and arranged to extend outwardly therefrom to lie in substantially coplanar relation to inclined top wall 236 of drink spout 260 when outlet closure 217 occupies the closed position as suggested in FIGS. 1-3. Lid 214 is thermoformed to position outlet closure 217 normally in the closed position in an illustrative embodiment. It is within the scope of the present disclosure to provide one or more frangible connectors like, for example, frangible connectors 41, 42 shown in FIG. 9A to retain closure plate 221 in its closed position initially.

Closure retainer 268 is formed in inclined top wall 236 of drink spout 260 as suggested in FIGS. 14-18. Closure retainer 268 is formed to include an upwardly facing plug-receiving cavity 268C bounded by four side walls 268S1, 268S2, 268S3, and 268S4 and a floor 268F arranged to mate with lower edges of side walls 268S1, 268S2, 268S3, and 268S4 as shown, for example, in FIG. 15. As suggested in FIG. 18, one or more of side walls 268S1, 268S2, 268S3, and 268S4 of closure retainer 268 are configured to cooperate to provide detent means for retaining a tip of nose-shaped plate-retainer plug 222 of outlet closure 220 in plug-receiving cavity 268C. It is within the scope of this disclosure to provide plate-retainer plug 222 with any suitable shape.

A lid 214 includes a central cover 216 and a brim mount 218 as shown, for example, in FIGS. 14 and 15. Central cover 216 is formed to include a liquid-discharge outlet 217 and an upwardly opening plug receiver 268. Brim mount 218 is arranged to surround central cover 216 and adapted to mate with the brim 26 of a cup 12. Brim mount 218 cooperates with central cover 216 to close a mouth opening into an interior region 13 formed in cup 12 and place liquid-discharge outlet 217 in fluid communication with interior region 13 of cup 12.

Lid 214 also includes an outlet closure 220 including a hinge 223 coupled to central cover 216 and a closure plate 221 appended to hinge 223 for movement relative to central cover 216 between a closed position closing liquid-discharge outlet 217 as shown in FIGS. 14 and 17 and an opened position opening liquid-discharge outlet 217 as shown in FIG. 18. Outlet closure 220 further includes a plate-retainer plug 222 coupled to closure plate 221 and arranged to extend upwardly away from a floor 28 of cup 12 when lid 12 is mounted on brim 26 of cup 12 and the closure plate 221 is in the closed position as suggested in FIG. 14. Plate-retainer plug 222 is configured to provide retainer means for nesting snugly to establish an interference fit in the upwardly opening plug receiver 268 formed in central cover 216 to retain closure plate 221 in the opened position at the option of a consumer as suggested in FIG. 18 so that the consumer can sip a liquid flowing outwardly from interior region 13 of cup 12 through liquid-discharge outlet 217 without allowing flapping motion of closure plate 221 relative to central cover 216 as the consumer drinks a liquid expelled from cup 12.

Central cover 216 includes an inclined top wall 236 formed to include the liquid-discharge outlet 217 and the upwardly opening plug receiver 268 and an endless side wall 238 arranged to surround inclined top wall 236 as suggested in FIG. 14. A top edge of endless side wall 238 is coupled to a perimeter edge of inclined top wall 236. Endless side wall 238 extends downwardly from the inclined top wall 236 to mate with brim mount 218 surrounding central cover 216. Inclined top wall 236 is inclined to lie in a non-horizontal plane when brim mount 218 of lid 214 is mated with brim 26 of cup 12. Endless side wall 238 is arranged to surround the upwardly opening plug receiver 268 and, when the plate-retainer plug 222 is arranged to extend into the upwardly opening plug receiver 268 to retain the closure plate 221 in the opened position as suggested in FIG. 18, to surround at least a tip of the plate-receiver plug 222 located in the upwardly opening plug receiver 268.

Inclined top wall 236 is sloped downwardly from a high point HP formed to include liquid-discharge outlet 217 toward an opposite low point LP to locate liquid-discharge outlet 217 at an elevation that is relatively higher than that of the upwardly opening plug receiver 268 as suggested in FIGS. 14 and 16. Endless side wall 238 includes a bottom edge that is coupled to brim mount 28 and the bottom and top edges are arranged to lie in spaced-apart relation to one another to define a height of the endless side wall 238 and wherein the height of the endless side wall 238 varies from a smallest dimension at the low point LP to a relatively greater largest dimension at the high point HP. The liquid-discharge outlet 217 and the upwardly opening plug receiver 268 are arranged to lie in spaced-apart relation to one another to locate hinge 223 of outlet closure 220 therebetween.

Endless side wall 238 has a convex exterior surface as suggested in FIGS. 14 and 16. A portion of the convex exterior surface of endless side wall 238 and a neighboring portion of an exterior surface of top wall 236 at the high point HP cooperate to form drink spout means 260 for mating with lower and upper lips of a consumer when the closure plate 221 is retained in the opened position by nesting engagement of plate-retainer plug 232 in the upwardly facing plug receiver 268.

Closure plate 221 has an annular shape and is formed to include an inner edge and an outer edge surrounding the inner edge as suggested in FIGS. 17 and 18. Plate-retainer plug 222 is coupled to closure plate 221 along the inner edge to lie in a fixed position on closure plate 221 for movement therewith relative to central cover 216. Hinge 223 is coupled to closure plate 221 at the outer edge.

Closure plate 221 has a non-round shape and, as shown in FIG. 15, comprises, in series, a first elongated segment 2211 located between plate-retainer plug 222 and hinge 223, a second elongated segment 2212 arranged to extend at about a right angle to hinge 223, a third elongated segment 2213 arranged to lie in spaced-apart relation to the first elongated segment 2211 to locate plate-retainer plug 222 therebetween, and a fourth elongated segment 2214 arranged to interconnect the first and third elongated segments 2211, 2213 and to lie in spaced-apart relation to the second elongated segment 2212 to locate plate-retainer plug 222 therebetween. Closure plate 221 has a substantially planar top surface that is arranged to lie in substantially coplanar relation to inclined top wall 236 upon movement of closure plate 221 to assume the closed position. The annular closure plate 221 is a flange coupled to a lower edge of plate-retainer plug 222 and arranged to cooperate with a portion of inclined top wall 236 of central cover 216 to define an acute angle therebetween when plate-retainer plug 222 is moved to extend into the upwardly opening plug receiver 268 formed in inclined top wall 236 of central cover 216 as suggested in FIG. 18.

The upwardly opening plug receiver 268 is defined by a plug-receiving cavity bounded by four side walls and a floor arranged to mate with lower edges of the four side walls. At least one of the four side walls is configured and arranged to provide detent means for retaining a tip of plate-retainer plug 222 in the plug-receiving cavity defined by upwardly opening plug receiver as suggested in FIG. 18.

Inclined top wall 236 is sloped downwardly from a high point HP formed to include liquid-discharge outlet 217 toward an opposite low point LP to locate liquid-discharge outlet 217 at an elevation that is relatively higher than that of the upwardly opening plug receiver 268. Inclined top wall 236 includes a crescent-shaped upper level 236U comprising the high point HP, liquid-discharge outlet 217, and plug receiver 268, and a central lower level comprising the low point LP. The upper level 236U includes a center platform 236UC formed to include the high point HP, liquid-discharge outlet 217, and upwardly opening plug receiver 268 and to position liquid-discharge outlet 217 between upwardly opening plug receiver 268 and sloped first and second curved ridges 236R1, 236R2 sweeping downwardly from the center platform 236UC in opposite directions along a perimeter edge of inclined top wall 236 to end in close proximity to one another to locate the low point LP therebetween.

The invention claimed is:

1. A lid comprising a central cover formed to include a liquid-discharge outlet and an upwardly opening plug receiver, a brim mount arranged to surround the central cover and adapted to mate with a brim of a cup and cooperate with the central cover to close a mouth opening into an interior region formed in the cup and place the liquid-discharge outlet in fluid communication with the interior region of the cup, and an outlet closure including a hinge coupled to the central cover, a closure plate appended to the hinge for movement relative to the central cover between a closed position closing the liquid-discharge outlet and an opened position opening the liquid-discharge outlet, and a plate-retainer plug coupled to the closure plate and arranged to extend upwardly away from a floor of the cup when the lid is mounted on the brim of the cup and the closure plate is in the closed position, wherein the plate-retainer plug is configured to provide retainer means for nesting snugly to establish an interference fit in the upwardly opening plug receiver formed in the central cover to retain the closure plate in the opened position at the option of a consumer so that the consumer can sip a liquid flowing outwardly from the interior region of the cup through the liquid-discharge outlet without allowing flapping motion of the closure plate relative to the central cover as the consumer drinks a liquid expelled from the cup, wherein the central cover includes an inclined top wall formed to include the liquid-discharge outlet and the upwardly opening plug receiver and an endless side wall arranged to surround the inclined top wall, a top edge of the endless side wall is coupled to a perimeter edge of the inclined top wall, the endless side wall extends downwardly from the inclined top wall to mate with the brim mount surrounding the central cover, and wherein the inclined top wall is inclined to lie in a non-horizontal plane when the brim mount of the lid is mated with the brim of the cup and the endless side wall is arranged to surround the upwardly opening plug receiver and, when the plate-retainer plug is arranged to extend into the upwardly opening plug receiver to retain the closure plate in the opened position, to surround at least a tip of the plate-receiver plug located in the upwardly opening plug receiver.

2. The lid of claim 1, wherein the inclined top wall is sloped downwardly from a high point formed to include the liquid-discharge outlet toward an opposite low point to locate the liquid-discharge outlet at an elevation that is relatively higher than that of the upwardly opening plug receiver.

3. The lid of claim 2, wherein the endless side wall includes a bottom edge that is coupled to the brim mount and the bottom and top edges are arranged to lie in spaced-apart relation to one another to define a height of the endless side wall and wherein the height of the endless side wall varies from a smallest dimension at the low point to a relatively greater largest dimension at the high point.

4. The lid of claim 1, wherein the liquid-discharge outlet and the upwardly opening plug receiver are arranged to lie in spaced-apart relation to one another to locate the hinge of the outlet closure therebetween.

5. The lid of claim 1, wherein the endless side wall has a convex exterior surface.

6. The lid of claim 5, wherein a portion of the convex exterior surface of the endless side wall and a neighboring portion of an exterior surface of the top wall at the high point cooperate to form drink spout means for mating with lower and upper lips of a consumer when the closure plate is retained in the opened position by nesting engagement of the plate-retainer plug in the upwardly facing plug receiver.

7. The lid of claim 1, wherein the closure plate has an annular shape and is formed to include an inner edge and an outer edge surrounding the inner edge, the plate-retainer plug is coupled to the closure plate along the inner edge to lie in a fixed position on the closure plate for movement therewith relative to the central cover, and the hinge is coupled to the closure plate at the outer edge and wherein the closure plate has a substantially planar top surface that is arranged to lie in substantially coplanar relation to the inclined top wall included in the central cover upon movement of the closure plate to assume the closed position.

8. The lid of claim 6, wherein the closure plate has a non-round shape and comprises, in series, a first elongated segment located between the plate-retainer plug and the hinge, a second elongated segment arranged to extend at about a right angle to the hinge, a third elongated segment arranged to lie in spaced-apart relation to the first elongated segment to locate the plate-retainer plug therebetween, and a fourth elongated segment arranged to interconnect the first and third elongated segments and to lie in spaced-apart relation to the second elongated segment to locate the plate-retainer plug therebetween.

9. The lid of claim 1, wherein the annular closure plate is a flange coupled to a lower edge of the plate-retainer plug and arranged to cooperate with a portion of the inclined top wall of the central cover to define an acute angle therebetween when the plate-retainer plug is moved to extend into the upwardly opening plug receiver formed in the inclined top wall of the central cover.

10. The lid of claim 1, wherein the upwardly opening plug receiver is defined by a plug-receiving cavity bounded by four side walls and a floor arranged to mate with lower edges of the four side walls and at least two of the four side walls cooperate to provide detent means for retaining a tip of the plate-retainer plug in the plug-receiving cavity.

11. The lid of claim 1, wherein the upwardly opening plug receiver includes a border ring coupled to the inclined top wall, a lower bowl arranged to lie below the border ring, and an intermediate ring arranged to interconnect the border ring and the lower bowl, the border ring is characterized by a first slope, the intermediate ring is characterized by a relatively steeper second slope, and the border ring is configured to provide lead-in ramp means for guiding the plate-retainer plug into a space bounded by the intermediate ring and into a lower elevation space bounded by the lower bowl during movement of the closure plate to the closed position.

12. The lid of claim 11, wherein the hinge is extensible and made of an elastic material to stretch and retract as needed during movement of the plate-retainer plug into the spaces provided in the plug receiver and during movement of the closure plate from an opened position to the closed position.

13. The lid of claim 1, wherein the inclined top wall is sloped downwardly from a high point formed to include the liquid-discharge outlet toward an opposite low point to locate the liquid-discharge outlet at an elevation that is relatively higher than that of the upwardly opening plug receiver, the inclined top wall includes a crescent-shaped upper level comprising the high point, the liquid-discharge outlet, and the plug receiver, and a central lower level comprising the low point.

14. The lid of claim 13, wherein the upper level includes a center platform formed to include the high point, the liquid-discharge outlet, and the upwardly opening plug receiver and to position the liquid-discharge outlet between the upwardly opening plug receiver and sloped first and second curved ridges sweeping downwardly from the center platform in opposite directions along a perimeter edge of the inclined top wall to end in close proximity to one another to locate the low point therebetween.

15. A lid comprising a central cover formed to include a liquid-discharge outlet and an upwardly opening plug receiver, a brim mount arranged to surround the central cover and adapted to mate with a brim of a cup and cooperate with the central cover to close a mouth opening into an interior region formed in the cup and place the liquid-discharge outlet in fluid communication with the interior region of the cup, and an outlet closure including a hinge coupled to the central cover, a closure plate appended to the hinge for movement relative to the central cover between a closed position closing the liquid-discharge outlet and an opened position opening the liquid-discharge outlet, and a plate-retainer plug coupled to the closure plate and arranged to extend upwardly away from a floor of the cup when the lid is mounted on the brim of the cup and the closure plate is in the closed position, wherein the plate-retainer plug is configured to provide retainer means for nesting snugly to establish an interference fit in the upwardly opening plug receiver formed in the central cover to retain the closure plate in the opened position at the option of a consumer so that the consumer can sip a liquid flowing outwardly from the interior region of the cup through the liquid-discharge outlet without allowing flapping motion of the closure plate relative to the central cover as the consumer drinks a liquid expelled from the cup, wherein the hinge is extensible and made of an elastic material to stretch and retract as needed during movement of the plate-retainer plug into the spaces provided in the plug receiver and during movement of the closure plate from an opened position to the closed position and wherein the upwardly opening plug receiver includes a border ring coupled to the inclined top wall, a lower bowl arranged to lie below the border ring, and an intermediate ring arranged to interconnect the border ring and the lower bowl, the border ring is characterized by a first slope, the intermediate ring is characterized by a relatively steeper second slope, and the border ring is configured to provide lead-in ramp means for guiding the plate-retainer plug into a space bounded by the intermediate ring and into a lower elevation space bounded by the lower bowl during movement of the closure plate to the closed position.

16. A lid comprising a central cover formed to include a liquid-discharge outlet and an upwardly opening plug receiver, a brim mount arranged to surround the central cover and adapted to mate with a brim of a cup and cooperate with the central cover to close a mouth opening into an interior region formed in the cup and place the liquid-discharge outlet in fluid communication with the interior region of the cup, and an outlet closure including a hinge coupled to the central cover, the hinge extending upwardly away from the brim mount, a closure plate appended to the hinge for movement relative to the central cover between a closed position closing the liquid-discharge outlet and an opened position opening the liquid-discharge outlet, and a plate-retainer plug coupled to the closure plate and arranged to extend upwardly away from a floor of the cup when the lid is mounted on the brim of the cup and the closure plate is in the closed position, wherein the plate-retainer plug is configured to provide retainer means for nesting snugly to establish an interference fit in the upwardly opening plug receiver formed in the central cover to retain the closure plate in the opened position at the option of a consumer so that the consumer can sip a liquid flowing outwardly from the interior region of the cup through the liquid-discharge outlet without allowing flapping motion of the closure plate relative to the central cover as the consumer drinks a liquid expelled from the cup, wherein the hinge has a curved exterior surface, and wherein the curved exterior surface of the hinge extends above the central cover.

17. The lid of claim 16, wherein the curved exterior surface is convex.

18. The lid of claim 17, wherein the hinge has a half-round shape.

19. The lid of claim 16, wherein the hinge-is extensible and configured to stretch and retract.

20. The lid of claim 16, wherein the hinge has a half-round shape.

21. The lid of claim 16, wherein the liquid discharge outlet and the opening of the plug receiver are on a sloping planar surface.

22. A lid comprising a central cover including an upwardly facing wall formed to include a liquid-discharge outlet and a top aperture opening into an upwardly opening plug receiver, a brim mount arranged to surround the central cover and adapted to mate with a brim of a cup and cooperate with the central cover to close a mouth opening into an interior region formed in the cup and place the liquid-discharge outlet in fluid communication with the interior region of the cup, and an outlet closure including a hinge coupled to the central cover, the hinge extending upwardly away from the brim mount, a closure plate appended to the hinge for movement relative to the central cover between a closed position closing the liquid-discharge outlet and an opened position opening the liquid-discharge outlet, and a plate-retainer plug coupled to the closure plate and arranged to extend upwardly away from a floor of the cup when the lid is mounted on the brim of the cup and the closure plate is in the closed position, wherein the plate-retainer plug is configured to provide retainer means for nesting snugly to establish an interference fit in the upwardly opening plug receiver formed in the central cover to retain the closure plate in the opened position at the option of a consumer so that the consumer can sip a liquid flowing outwardly from the interior region of the cup through the liquid-discharge outlet without allowing flapping motion of the closure plate relative to the central cover as the consumer drinks a liquid expelled from the cup, wherein the closure plate has an annular shape and is formed to include an inner edge and an outer edge surrounding the inner edge, the plate-retainer plug is coupled to the closure plate along the inner edge to lie in a fixed position on the closure plate for movement therewith relative to the central cover, and the hinge is coupled to the closure plate at the outer edge, and wherein the outer edge is radially spaced apart from and surrounds the inner edge.

23. The lid of claim 22, wherein the outer edge is spaced apart from the inner edge.

* * * * *